United States Patent [19]

Perr

[11] Patent Number: 5,011,079

[45] Date of Patent: Apr. 30, 1991

[54] UNIT INJECTOR AND DRIVE TRAIN WITH IMPROVED PUSH ROD-PLUNGER CONNECTION

[75] Inventor: J. Victor Perr, Greenwood, Ind.

[73] Assignee: Cummins Engine Company, Inc., Columbus, Ind.

[21] Appl. No.: 568,633

[22] Filed: Aug. 16, 1990

Related U.S. Application Data

[63] Continuation of Ser. No. 315,612, Feb. 27, 1989, abandoned.

[51] Int. Cl.[5] ..... F02M 61/20

[52] U.S. Cl. ..... 239/95; 239/584

[58] Field of Search ..... 239/533.3–533.9, 239/95, 584; 74/55, 559; 123/508

[56] References Cited

U.S. PATENT DOCUMENTS

| | | | |
|---|---|---|---|
| Re. 24,633 | 4/1959 | Voorhies . | |
| 1,792,836 | 2/1931 | Handwerker . | |
| 2,144,861 | 1/1939 | Truxell, Jr. . | |
| 2,912,168 | 11/1959 | L'Orange | 239/533.7 X |
| 3,409,225 | 11/1968 | Maddalozzo et al. | 239/533.9 X |
| 3,544,008 | 12/1970 | Reiners et al. . | |
| 3,965,875 | 6/1976 | Perr . | |
| 4,571,161 | 2/1986 | LeBlanc et al. . | |
| 4,669,659 | 6/1987 | LeBlanc et al. | 239/95 X |

FOREIGN PATENT DOCUMENTS

| | | | |
|---|---|---|---|
| 899579 | 11/1953 | Fed. Rep. of Germany | 239/95 |
| 1066635 | 6/1954 | France | 239/95 |

*Primary Examiner*—Andres Kashnikow
*Assistant Examiner*—William Grant
*Attorney, Agent, or Firm*—Sixbey, Friedman, Leedom & Ferguson

[57] ABSTRACT

An injector drive train push-rod injector plunger connection for use in internal combustion engines is disclosed. The injector includes a body having an axial bore, a plunger, and a biasing mechanism which biases the plunger away from the injection chamber. The plunger is slidable within the bore. A push rod connects the plunger to a drive train assembly which includes a pivotable rocker arm. A first end of the push rod is connected to the plunger and a second end of the push rod is connected to the driven end of the rocker arm. The first end includes a spherical portion which is receivable in a complementarily-shaped concave portion disposed on the outer end of the plunger but not within the plunger. The spherical portion has a diameter at least equal to the outer diameter of the plunger. The load from the driving assembly is transmitted from the push rod to the plunger at the end of the plunger only. This arrangement reduces almost to elimination side loading on the plunger and on the fuel injector thereby reducing wear, preventing leakage and maintaining better control over the amount of injected fuel.

9 Claims, 3 Drawing Sheets

UNIT INJECTOR AND DRIVE TRAIN WITH IMPROVED PUSH ROD-PLUNGER CONNECTION

This application is a continuation of Ser. No. 315,612, filed Feb. 27, 1989, now abandoned.

TECHNICAL FIELD

The present invention relates to a unit fuel injector and drive train for use on internal combustion engines. More particularly, the present invention relates to a connection between the drive train push rod and the injector plunger that reduces the laterally directed forces normally applied to the injector thereby reducing wear and maintaining better injector control.

BACKGROUND OF THE INVENTION

In early cam operated drive trains, the effects of right angle forces were ignored. For example, Handwerker U.S. Pat. No. 1,792,836 discloses a cam operated drive train for a valve mechanism using a simple connection between rocker arm 19 and valve stem 14. In this system, no push rod is used and the rocker arm directly contacts the top of the valve stem. The end of the rocker arm contacting the valve stem is rounded and its contact portion on the valve stem is flat. The valve stem translates and this translation is caused by the rotation of the rocker arm. However, there is no intermediate element to efficiently convert the rotational motion of the rocker arm to the translational motion of the valve stem. The rotation of the rocker arm over the relatively short distance that the valve stem translates is theoretically approximated by a straight line. However, in practice, this approximation ignores the significant sideways loads and thrusts imposed on the valve stem. Furthermore, eventually, the rounded end of the rocker arm could wear away the top of the valve stem in a concave fashion. This concavity could cause the sideways loads on the valve to still further increase tremendously.

While the increased wear caused by the side loads induced by the drive train illustrated in Handwerker could possibly be tolerated in a valve guide, such an approach could lead to very early and costly malfunction of a unit fuel injector.

One partial solution to the side loading problem presented by Handwerker-type systems has been to use a push rod as the link between the rocker arm and the lower plunger of the injector plunger. This approach reduces much of the frictional sliding contact inherent in the Handwerker-type drive train. In cam operated unit fuel injectors using push rod links, the injector typically includes an injector plunger mounted for reciprocal movement within a bore of the injector body. Reciprocal movement of the plunger is induced by a rotating cam operating through the injector drive train typically including a cam follower connected to one end of a connecting rod which is in turn connected at its other end to a rocker arm. The rocker arm is rotatably mounted on a pivot disposed in a central portion of the rocker arm. At one end the rocker arm is connected to the connecting rod and at the other end, on the opposite side of the pivot, the rocker arm is connected to a push rod. The push rod is, in turn, connected to the injector plunger. Thus, as the cam on the camshaft rotates, the cam follower and connecting rod reciprocate. This reciprocation rotationally oscillates the rocker arm around its pivot to cause the push rod to reciprocate, and therefore the plunger to reciprocate, in the direction opposite that of the cam follower and connecting rod.

Two examples of fuel injectors using this type of drive train connection system are disclosed in Perr, U.S. Pat. No. 3,965,875 and Reiners, U.S. Pat. No. 3,544,008, both of which are commonly assigned to the assignee of the present invention, Cummins Engine Company, Inc. As illustrated in these patents, (reference will be made to FIG. 2 of the '008 patent for clarity) the injector plunger actually is formed of two separate but connected components, a lower plunger 37 which translates within the injection chamber and an upper plunger or sleeve portion 72 which extends from the lower plunger to the upper ends of the plunger body. The upper plunger is hollow along substantially its entire length to receive a push rod, link 29 which contacts the rocker arm at its upper end. The lower end 83 of the push rod is spherically formed and is received in a complementarily shaped seat 84 in the inner lower end of the upper plunger.

The reciprocating movement of the push rod is only approximately linear due to the rotation of the rocker arm. Therefore, the push rod receives a force component at right angles to the desired direction of translation. The magnitude of the right angle forces on the plunger will vary with the particular drive train design but such right angle forces can lead to extreme wear in the surfaces of the plunger and the mating surfaces of the injector body bore in which the plunger is received.

As illustrated in the '875 and '008 patents, additional improvement can be achieved by elongating the push rod a substantial distance into the injector body axial bore which receives the plunger. By lengthening the push rod, the reciprocal movement of the push rod will become more nearly linear thereby minimizing the laterally directed force on the plunger. However, these systems result in high levels of wear at the socket between the push rod and the plunger, at the top of the lower plunger disposed in the injection chamber. Additionally, there still remains a significant sideways force component which causes further wear on the injector plunger and plunger bore which can result in excessive fuel leakage and a loss of control over the amount of fuel injected per injection stroke. This is a very serious limitation with fuel injectors because the precise and accurate control of fuel metered into the combustion chamber through the fuel injector is critical to efficient proper performance of the engine.

Leblanc et al., U.S. Pat. No. 4,571,161, is directed to a fuel injector having a socket for receiving a drive train push rod located at the upper portions of the plunger assembly near the top of the injector body. In this configuration, the side loading on the plunger adjacent the injection chamber is removed and is applied to the sliding tappet 19 mounted on plunger 17. However, this results in increasing the load on the tappet socket. Also, because of the configuration of the fuel injector, the size of the socket connection is constrained because the socket is located within a portion of the tappet that is located entirely within the inner diameter of the return spring. This causes the contact surface between the end of a push rod and the tappet to be disposed totally below the upper end of the return spring.

A drive train configuration similar to Handwerker's but applied to the actuation of a fuel injector is found in Truxell, Jr. U.S. Pat. No. 2,144,861 in which ball ended member 27 formed on one end of rocker arm 24 is disposed within block 26 disposed on top of plunger follower 21. In Truxell, the block is free to slide horizontally on plunger follower 21 thereby avoiding some of the disadvantages of the Handwerker mechanism but still creating and transmitting sideways loads on the plunger follower and on the injector as a whole.

In Maddalozzo, U.S. Pat. No. 3,409,225 another prior art plunger-driving assembly connection is shown. Rocker 52 is connected to the upper portion of plunger assembly 18 through slipper 56 which is the sole link between the injector plunger assembly and the rocker arm. Slipper 56 has an indentation for receiving a downward projection of rocker arm 52. The precise relationship of slipper 56 and cup 26 is not disclosed. Moreover, Maddalozzo et al. fails to disclose a push rod between the rocker arm and the plunger assembly.

Although spherical connections between the push rod and plunger located near the outer surface of the plunger and outside of the injector housing bore have been employed, heretofore there has been no simple connection which reduces almost to elimination the sideways stresses on the fuel injector to reduce plunger wear at the connection and maintain control over fuel injection.

SUMMARY OF THE INVENTION

It is an object of the present invention to provide a fuel injection system including an injection train having a push rod between the injector plunger and a centrally pivoting rocker arm wherein the connection between the push rod and the plunger reduces side thrusting and side loading at the lower portion of the plunger while reducing wear at the push rod-plunger connection.

It is another object of the present invention to provide a push rod-plunger connection that prevents the injector from sticking and reduces wear of the injector.

It is another object of the present invention to provide a push rod-plunger connection that prevents fuel leakage and reduces any deterioration of control over the amount of fuel injected.

It is another object of the present invention to accomplish the above goals with a push rod-plunger connection that is located at one end of the plunger outside of the plunger.

It is another object of the present invention to accomplish the above goals with a push rod-plunger connection having sufficient material in the plunger portion of the connection without enlarging the upper diameter of the fuel injector.

It is another object of the present invention to accomplish the above goals with a push rod-plunger connection for a PT fuel injector by increasing the ball and socket connection substantially by a factor of two and locating the socket portion of the connection on top of the injector without otherwise significantly modifying the injector.

It is another object of the present invention to accomplish the above goals with a push rod-plunger connection that includes a ball and socket connection in which the diameter of the ball is at least equal to the diameter of the plunger.

These and other objects are attained by the injector train push rod-piston connection according to the present invention. The connection is used with known injection trains which include an injector body having an axial bore with an injection chamber having injection nozzles, a plunger, and a biasing mechanism which biases the plunger away from the injection chamber. The plunger is slidable within the bore and has an inner end and an outer end. A push rod having first and second ends connects the plunger to a drive assembly which includes a pivotable rocker arm. A first end of the push rod is connected to the plunger and a second end of the push rod is connected to the driven end of the rocker arm. The first end includes a spherical portion which is receivable in a complementarily-shaped concave portion disposed on the outer end of the plunger but not within the plunger. The spherical portion has a diameter at least equal to the outer diameter of the plunger, and in some embodiments the diameter is at least equal to the inner diameter of a plunger-surrounding coil spring which serves as the biasing mechanism. The size of the spherical portion and the complementary concave portion is twice that of conventional connections used with otherwise identical PT injectors. To provide adequate material for the concave portion without increasing the diameter of the biasing mechanism and therefore the size of the injector, the concave portion is located at a location that causes at least a portion of the contact surface between the push rod and the plunger to be located above the top of the biasing mechanism. Due to the size and location of the spherical portion, the load from the driving assembly is transmitted from the push rod to the plunger at the upper end of the plunger. This reduces almost to elimination side loading on the lower portion of the plunger and on the fuel injector thereby reducing wear, preventing leakage, and maintaining control over the amount of injected fuel.

The connection may also be used with valves in which a push rod is connected to a valve stem on the driven side of a rocker arm. The push rod is connected to the top of a valve stem using the spherical portion-concave portion interface in which the diameter of the spherical portion is at least equal to the outer diameter of the valve stem. This reduces side loading on the valve which thereby reduces wear, preventing leakage and valve sticking.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

Figure 1:
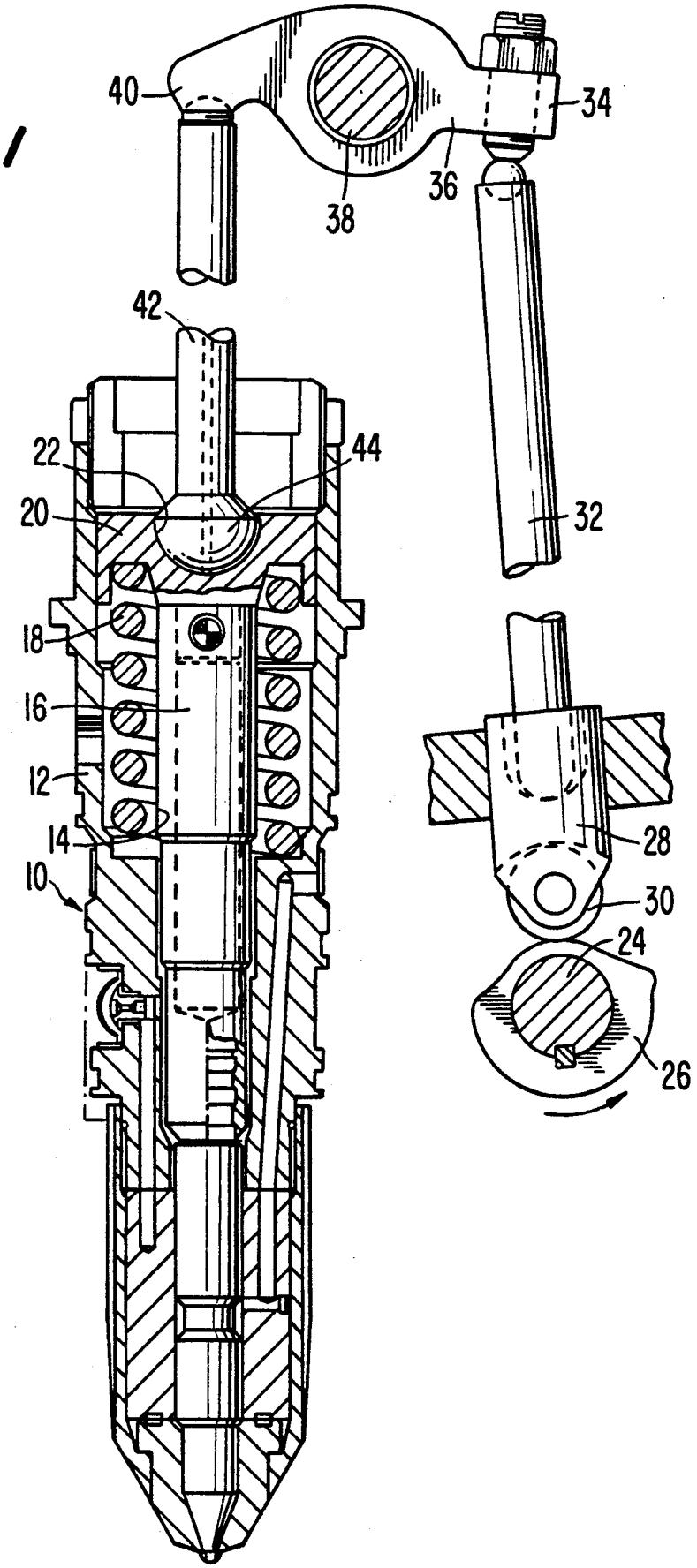
FIG. 1 is a sectional view of an injection train having a push rod-piston connection according to the present invention.

FIG. 1 illustrates one embodiment of an injection train with an improved connection between the push rod and the injector plunger. In particular, the improved connection is used with fuel injectors commonly known as PT fuel injectors, such as those manufactured by Cummins Engine Company. Injector 10 includes injector body 12, axial bore 14 including an injection chamber, and plunger 16 slidable within axial bore 14. Coil spring 18 surrounds the upper portion of plunger 16 and biases plunger 16 in a retracted position away from the injection chamber. Disposed on the outer end of plunger 16 is push rod receiving portion 20 which also serves as the upper wall against which coil spring 18 acts. Push rod receiving portion 20 may be integrally formed with plunger 16 or may be a separately formed component and includes concave recess 22. Push rod receiving portion includes a radially outer portion which receives the upper end of coil spring 18 and a radially inner portion which includes concave recess 22.

The injection train is driven by a driving assembly which includes camshaft 24 having cam 26. Cam follower 28 including pinned roller 30 rides on cam 26 and translates connecting rod 32. Connecting rod 32 is, in turn, connected to the driving end 34 of rocker arm 36. Rocker arm 36 rotates around pivot 38, and the driven end 40 is connected to push rod 42 having spherical portion 44.

As shown in the figures, spherical portion 44 is complementarily received in concave recess 22 of push rod receiving portion 20. Spherical portion 44 has a diameter equal to or greater than the outer diameter of plunger 16. The diameter of spherical portion 44 can be equal to or greater than the inner diameter of coil spring 18. This is substantially twice the size of prior art ball and socket type connections used with similar PT injectors. This configuration allows spherical portion 44 to pivot or rotate within concave recess 22 as push rod 42 is reciprocatably disclosed by the rotational motion of rocker arm 36. However, because the diameter of concave recess 22 is increased, the loading forces at the push-rod connection are distributed over a larger contact area, thereby reducing wear at this connection. Also, although driven end 40 of rocker arm 36 travels along an arcuate path and provides a sideways force to push rod 42 in addition to the vertical force component used to translate plunger 16 within axial bore 14, the side loading on the lower portion of plunger 16 and injector 10 is vastly reduced because the force transmitted through push rod 42 is transferred to injector 10 at the outer end only of plunger 16. As a result, wear on both the lower portion of the plunger 16 and the lower portion of bore 14 is reduced. These advantages are accomplished notwithstanding that a shorter push rod is used as the link between the rocker arm and the injector plunger.

In order to accomodate the connection having an enlarged spherical portion 44 and enlarged concave recess 22 it is necessary to insure that push rod receiving portion 20 is sufficiently strong. It is not desirable to simply increase the overall size by increasing the outer diameter of push rod receiving portion 20. As accurately illustrated in the device of Leblanc, this would require enlarging the size of the coil spring which serves as the plunger biasing mechanism. Increasing the size of any component that increases the overall size of the internal combustion engine is never desirable due to the very limited space in the engine compartment. Therefore, to adequately strengthen push rod receiving portion 20 by providing sufficient material in the region of concave recess 22, the concave recess is set within push rod receiving portion 20 at a higher location. Specifically, it has been found that locating concave recess 22 so that at least a portion of the contact surface between spherical portion 44 and concave recess 22 is located above the top of coil spring 18 provides sufficient strength. Adequate material is provided adjacent concave recess 22 without enlarging the diameter of coil spring 18 or injector body 12.

The reduction of side thrusts and side loads on the injector effected by the connection between spherical portion 44 and concave recess 22 prevents heavy wear on plunger 16 and injector 10 as a whole. This thereby reduces incidents of the injector sticking and reduces fuel leakage and reduces any loss of control over the amount of fuel injected caused by increased wear. This is a highly desirable improvement. As is well known, even slight variations of less than 1% in the amount of fuel injected into an expansible chamber device such as an internal combustion engine drastically affect performance. Thus, the connection system of the present invention is critical to controlling fuel injection and performance.

Figure 2:
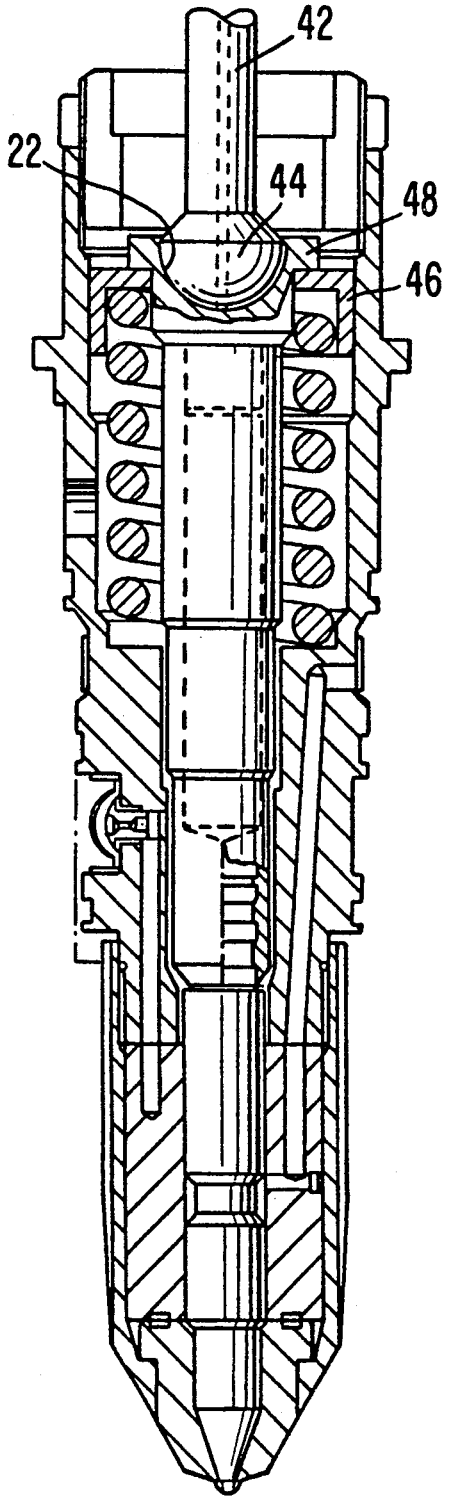
FIG. 2 is a sectional view of another embodiment of the push rod-piston connection according to the present invention.
Figure 3:
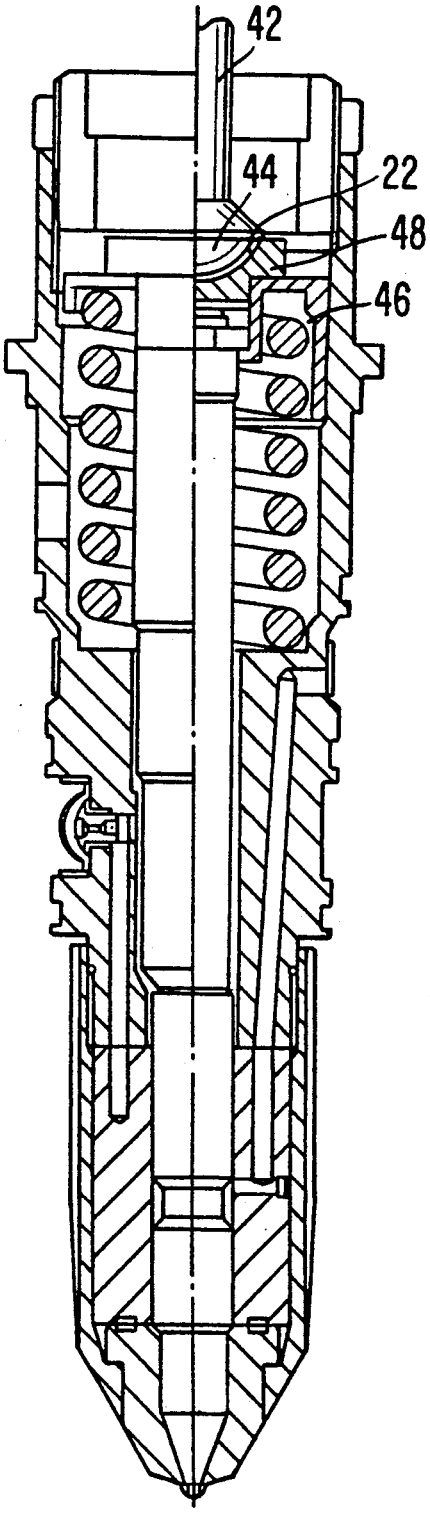
FIG. 3 is a sectional view of another embodiment of the push rod-piston connection according to the present invention.

FIGS. 2 and 3 illustrate modifications of the connection between spherical portion 44 of push rod 42 and concave recess 22 of push rod receiving portion 20. In these figures, the driving assembly is eliminated for clarity and the injectors are the same as injector 10 of FIG. 1. In these embodiments, the difference from the embodiment of FIG. 1 lies in the configuration of push rod receiving portion 20 which is formed of a plurality of components. In both of these embodiments, push rod receiving portion 20 is formed of an outer coil spring receiving portion 46 and an inner recess forming portion 48. Inner recess forming portion 48 receives spherical portion 44 of push rod 42.

In another alternate embodiment, it is envisioned that concave recess 22 may be formed on push rod 42 and spherical portion 44 may be disposed on the outer end of plunger 16. Additionally, it is envisioned that the ball and socket type connection as described above could be used to connect a push rod to a valve stem of a valve assembly according to the present invention. Such a connection would reduce wear in valves and therefore would reduce the chances of the valve sticking and would decrease the incidence of leakage in valves. In adapting this invention for use with valve assemblies the connection components as described above need be modified only to the extent required to size them to the valve assembly.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

INDUSTRIAL APPLICABILITY

The connection system between the push rod and the injector plunger of the present invention is very important in controlling fuel injection. The present invention therefore finds application with fuel injection systems for all types of expansive chamber devices such as internal combustion engines. The connection system reduces wear and increases the operating life of fuel injection trains.

I claim:

1. A fuel injector assembly adapted to be operated intermittently by an injector drive train having a pivotable arm comprising:

an injector body having a bore;

a plunger assembly mounted for reciprocal movement within said injector body bore, said plunger assembly including a lower portion mounted for sliding movement within a lower section of said injector body bore and an upper portion mounted for sliding movement within an upper section of said injector body;

a push rod having a first end and a second end, said first end connected to one side of the pivotable arm, said second end of said push rod having a spherical portion;

a connection means for pivotally joining said push rod to said upper portion of said plunger assembly in a manner to minimize wear between said push rod and said plunger assembly, said connection beans having a concave portion complimentary in shape to said spherical portion for receiving said spherical portion, said concave portion and said spherical portion having a diameter equal to at least the outer diameter of said lower portion of said plunger assembly.

2. A fuel injector assembly according to claim 1, wherein said concave portion is integrally formed as part of said plunger assembly.

3. A fuel injector assembly according to claim 1, wherein said injector drive train includes a coil spring surrounding said plunger assembly for biasing said plunger assembly and wherein the diameter of said spherical portion is at least equal to the inner diameter of said coil spring.

4. A fuel injector assembly according to claim 3, wherein said connection means further comprises a coil spring receiving portion which receives a top end of said coil spring.

5. A fuel injector assembly according to claim 4, wherein the concave portion and said coil spring receiving portion of said connection means are formed as separate elements.

6. A fuel injector assembly operated in response to an injector drive train having a pivotable arm comprising:

an injector body having a bore;

a plunger assembly mounted for reciprocal movement within said injector body bore, said plunger assembly including a lower portion mounted for sliding movement within a lower section of said injector body bore and an upper portion mounted for sliding movement within an upper section of said injector body;

a push rod having a first end and a second end, said first end connected to one side of the pivotable arm, said second end of said push rod having a spherical portion;

a biasing means for biasing said plunger assembly upwardly in said bore;

a connection means for pivotally joining said push rod to said upper portion of said plunger assembly in a manner to minimize wear between said push rod and said plunger assembly, said connection means having a concave portion complimentary in shape to said spherical portion for receiving said spherical portion, said concave portion and said spherical portion having a diameter equal to at least the outer diameter of the lower portion of said plunger assembly, said connection means including a side load transmitting means for transmitting side loading forces to said upper section of said injector body.

7. A fuel injector assembly according to claim 6, wherein said biasing means comprises a coil spring surrounding said plunger assembly and the diameter of said spherical portion is at least equal to the inner diameter of said coil spring.

8. A fuel injector assembly according to claim 6, wherein said connection means further comprises a coil spring receiving portion which receives a top end of said coil spring.

9. A fuel injector assembly according to claim 8, wherein said concave portion and said coil spring receiving portion of said connection means are formed as separate elements.

* * * * *